US006725602B1

(12) United States Patent
McWilliams

(10) Patent No.: US 6,725,602 B1
(45) Date of Patent: Apr. 27, 2004

(54) AUTOMATICALLY EXTENDABLE ASTRAGAL SYSTEM

(76) Inventor: William A. McWilliams, 914 W. Coronado Rd., Phoenix, AZ (US) 85007

( * ) Notice: Subject to any disclaimer, the term of this patent is extended or adjusted under 35 U.S.C. 154(b) by 0 days.

(21) Appl. No.: 10/348,429

(22) Filed: Jan. 21, 2003

(51) Int. Cl.[7] ..... E05F 15/20

(52) U.S. Cl. ..... 49/31; 49/365; 49/367; 49/7

(58) Field of Search ..... 49/1, 7, 31, 21, 49/394, 366, 367, 365; 292/DIG. 66, DIG. 65; 70/DIG. 10

(56) References Cited

U.S. PATENT DOCUMENTS 4,819,378 A * 4/1989 Ando ..... 49/225
5,377,784 A * 1/1995 Walkowiak et al. ..... 49/120
5,794,382 A * 8/1998 Prucinsky ..... 49/365
5,943,824 A 8/1999 Tatara

* cited by examiner

*Primary Examiner*—Jerry Redman
(74) *Attorney, Agent, or Firm*—Jordan M. Meschkow; Lowell W. Gresham; Meschkow & Gresham, PLC

(57) ABSTRACT

An extendable astragal system (40) includes a housing (47), an actuating member (48) located in and slidably engaged with the housing (47), and an astragal (50) located in the housing (47) and slidably engaged with the housing (47) and the actuating member (48). A latch mechanism (80) retains the astragal (50) within the housing (47) when an ambient temperature is below a predetermined temperature. The latch mechanism (80) enables sliding movement of the actuating member (48) and resultant movement of the astragal (50) to an extended position outside of the housing (47) when the ambient temperature is at the predetermined temperature.

20 Claims, 6 Drawing Sheets

AUTOMATICALLY EXTENDABLE ASTRAGAL SYSTEM

TECHNICAL FIELD OF THE INVENTION

The present invention relates to the field of doors. More specifically, the present invention relates to an astragal system for swinging-type hinged doors.

BACKGROUND OF THE INVENTION

A double door system includes a pair of hinged swinging-type doors, one of which is typically the active door and the other of which is typically the inactive door. An active door is the door that opens first and is the one to which the latch is applied. An inactive door is the door that is bolted when closed and to which the lock strike is fastened to receive the latch of the active door.

Due to the clearances needed and the geometry of swing of a pair of doors, a gap generally occurs between the pair of doors at their meeting edges when the two doors are completely closed. This clearance gap is typically between one quarter and three eighths of an inch wide. Accordingly, double doors can include an astragal closing this clearance gap for the purpose of either providing a weather seal, minimizing the passage of light between the doors, or retarding the passage of smoke or flame during a fire.

Some prior art astragals overlap the clearance gap. For example, an astragal may be attached to the active door and extend laterally from the edge of the door to overlap the gap. Other astragals meet at the centerline of the gap (sometimes referred to as a split astragal).

Door closing coordinators are well known in the art and serve the function of controlling the sequence in which the inactive and active doors close. Door closing coordinators are commonly used in conjunction with doors that have some type of automatic door closing mechanism that will move a door from an open to a closed position after the door has been released. The coordinators ensure that the inactive door reaches a fully closed position before the active door regardless of the relative positions the doors are in when they are released, the speed with which each door closes, or other variables. Coordinators are necessary when an overlapping astragal is present so that the door fitted with the astragal closes last, thereby allowing the pair of doors to close properly.

While a variety of coordinators are known, many have certain shortcomings. Some coordinators are mounted on the door headers in a completely exposed location. Such coordinators are unsightly. More recent coordinators are fabricated to be mounted under the header door stop. These designs are far superior in appearance to the exposed coordinators. Unfortunately, however, these coordinators require frequent maintenance and adjustment. Due to wear on the coordinators, adjustment is particularly critical with a very active entry. The excessive wear causes the coordinators to readily fall out of adjustment, resulting in the hazardous situation in which the doors fail to close and latch properly every time.

A fire door assembly is any combination of a fire door (single or double doors), a frame, hardware, and other accessories that together provide a specific degree of fire protection to the opening, while at the same time allowing building occupants to pass through.

The National Fire Protection Association (NFPA) is an international organization that provides and advocates scientifically-based consensus codes and standards, research, training, and education. The NFPA 80 is the standard for fire doors and fire windows. NFPA 80 covers the installation and maintenance of fire door assemblies, windows, glass blocks, and shutters for the protection of openings to restrict the spread of fire and smoke within buildings, whether from interior fire or from external fire, including arrangements for automatic operation in case of fire.

Regarding the operation of fire doors, NFPA 80 specifies that all swinging doors shall be closed and latched at the time of fire and shall close and latch thereafter each time it is opened. The NFPA 80 further specifies that doors swinging in pairs and having a fire protection rating of more than one and a half hours shall have an overlapping astragal. In addition, pairs of doors that require astragals shall have at least one attached in place so as to protect approximately three quarters of an inch.

Inappropriately configured astragals and/or coordinators that fail to allow a pair of doors to close and latch properly can be irritating to individuals passing through the doors under normal use conditions. More critically, the failure of a pair of doors to close and latch properly in case of an interior or external fire can create an extremely hazardous situation in which the spread of fire and/or smoke is unrestricted. Thus, what is needed is an astragal system for a door that enables unrestricted opening and closing of doors under normal conditions, while restricting the spread of fire and smoke in the case of a fire.

SUMMARY OF THE INVENTION

Accordingly, it is an advantage of the present invention that an automatically extendable astragal system is provided.

It is another advantage of the present invention that an astragal system is provided that enables the free movement of either door in a double door assembly under normal use conditions.

Another advantage of the present invention is that an astragal system is provided with an overlapping configuration that meets NFPA standards for fire doors.

Yet another advantage of the present invention is that an astragal system is provided that precludes the need for door coordinators.

The above and other advantages of the present invention are carried out in one form by an extendable astragal system for a door. The astragal system includes a housing, an actuating member located in the housing and slidably engaged with the housing, and an astragal located in the housing and slidably engaged with each of the housing and the actuating member. The astragal system further includes a latch mechanism retaining the astragal within the housing in a retracted position when an ambient temperature is below a predetermined temperature. The latch mechanism enables sliding movement of the actuating member and resultant movement of the astragal to an extended position outside of the housing when the ambient temperature is at the predetermined temperature.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
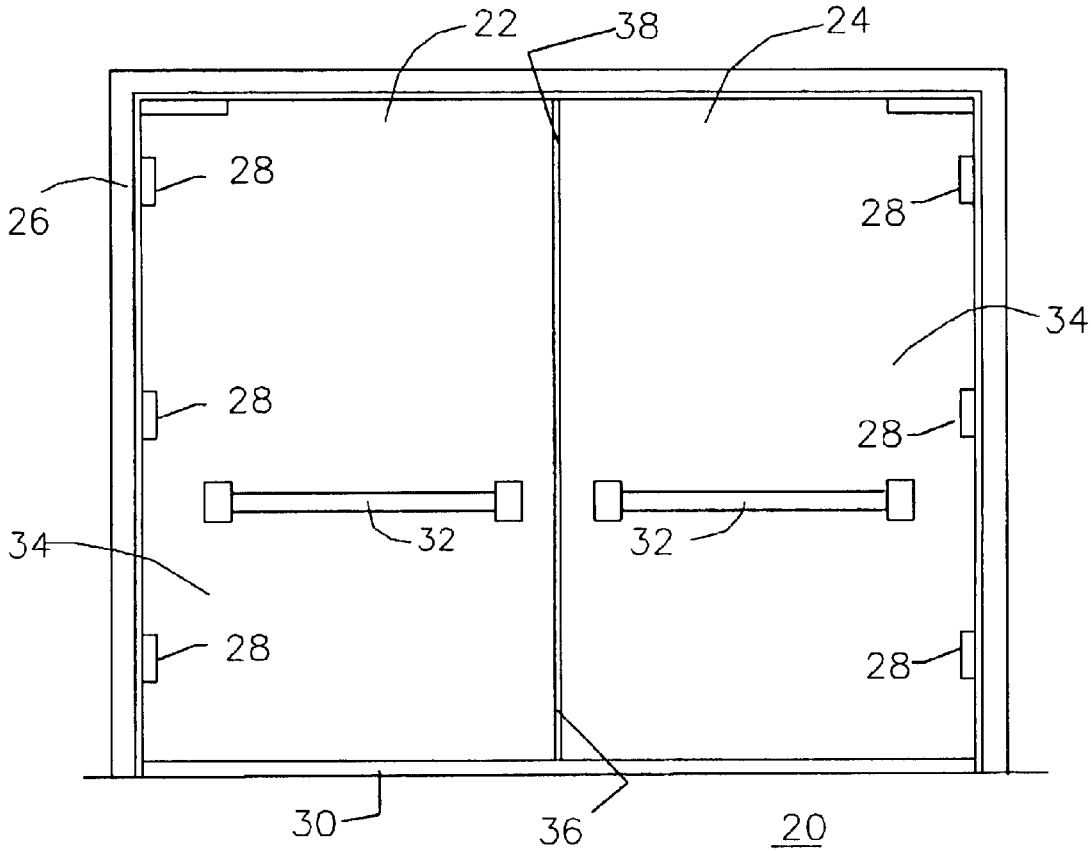
FIG. 1 shows a rear view of a fire door assembly.

FIG. 1 shows a rear view of a fire door assembly 20. Fire door assembly includes a pair of doors, i.e. a first door 22 and a second door 24 mounted in a single door frame 26. First and second doors 22 and 24, respectively, may be fabricated from any suitable fire rated material, such as wood or metal, and are mounted by hinges 28 on door frame 26 for swinging about parallel axes. Fire door assembly 20 may also include a metal threshold 30, door opening devices 32 coupled to an interior side 34 of first and second doors, and other accessories that together provide a specific degree of fire protection to the opening.

As previously discussed, the fire rating of a door opening can be adversely affected by the clearance gap between a first meeting edge 36 of first door 22 and a second meeting edge 38 of second door 24. The present invention provides an astragal that automatically extends to overlap the clearance gap between first and second meeting edges 36 and 38 during conditions of fire. Although the present invention will be described herein for use with double doors, it should become apparent to those skilled in the art that the astragal system described below is not limited to use for double doors. Rather, the astragal system may be employed to overlap a clearance gap between a single door and a door frame, between a pair of windows, between a window and a window frame, and so forth.

Figure 2:
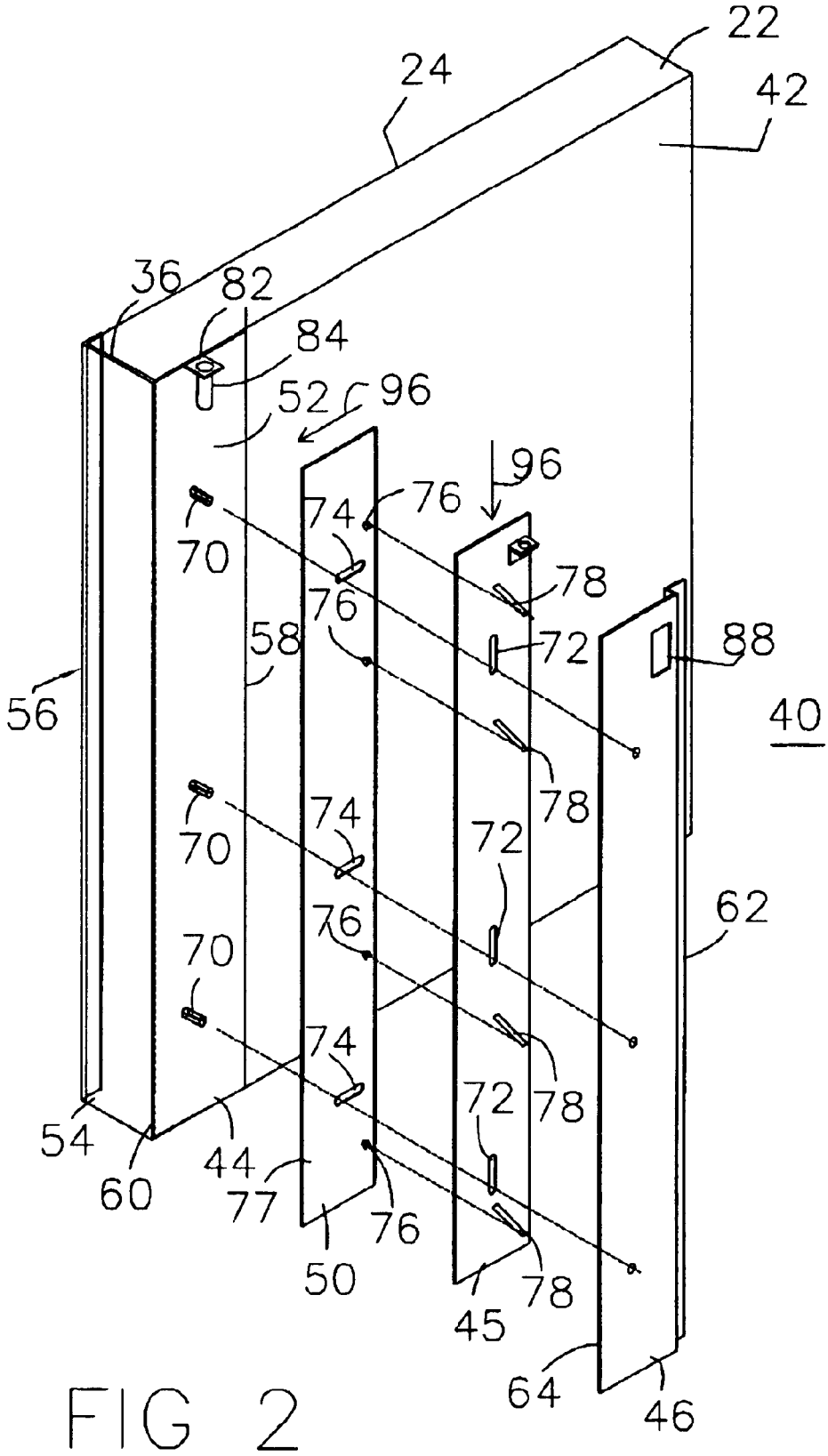
FIG. 2 shows an exploded view of an extendable astragal system for the fire door assembly of FIG. 1.

FIG. 2 shows an exploded view of an automatically extendable astragal system 40 for use with fire door assembly 20 (FIG. 1). By way of example, astragal system 40 is configured for attachment to an exterior side 42 of first door 22. Astragal system 40 includes a base 44 and a cover 46 that collectively form a housing 47 (see FIG. 3). Astragal system 40 further includes an actuating member 48 and an astragal 50.

In a preferred embodiment, base 44 has a first surface 52, a second surface 54 arranged perpendicularly to first surface 52, and a third surface 56 arranged perpendicularly to second surface 54 and in planar alignment with first surface 52. Accordingly, base 44 fits along first meeting edge 36 of first door 22 with first surface 52 abutting exterior side 42 and third surface 56 abutting interior side 34 of first door 22.

Base 44 includes a first longitudinal edge 58 and a second longitudinal edge 60. Similarly, cover 46 includes a third longitudinal edge 62 and a fourth longitudinal edge 64. First and third longitudinal edges 58 and 62, respectively, are aligned and coupled together via fasteners 66 (see FIG. 3) that attach housing 47 to first door 22. Second and fourth longitudinal edges 60 and 64, respectively, are aligned to define a slot 68, discussed below (see FIG. 3).

Spacer elements in the form of guide pins 70 extend between base 44 and cover 46 for maintaining a fixed distance between base 44 and cover 46. Guide pins 70 are secured to each of base 44 and cover 46 and extend through a width of housing 47. Actuating member 48 has first guide pin slots 72 oriented substantially vertically and astragal 50 has second guide pin slots 74 arranged perpendicular to first guide pin slots 72, thus resulting in a substantially horizontal orientation. Guide pins 70 extend through each of first and second guide pin slots 72 and 74, respectively.

Astragal 50 further includes peg members 76 extending from a surface 77 of astragal 50. Corresponding peg slots 78 are located in actuating member 48, in which peg members 76 slidably reside. Peg slots 78 are oriented at an acute angle relative to horizontal. In other words, peg slots 78 are upwardly sloped, with the slope being less than ninety degrees. In a preferred embodiment, peg members 76 are protrusions punched into astragal 50 utilizing a press.

Base 44, cover 46, actuating member 48, and astragal 50 may be fabricated out of, for example, fourteen gauge sheet metal. Guide pins 70 securing cover 46 to base 44 may be of a suitable length such that an overall width of the housing of astragal system 40 is five sixteenths to three eighths of an inch.

Figure 3:
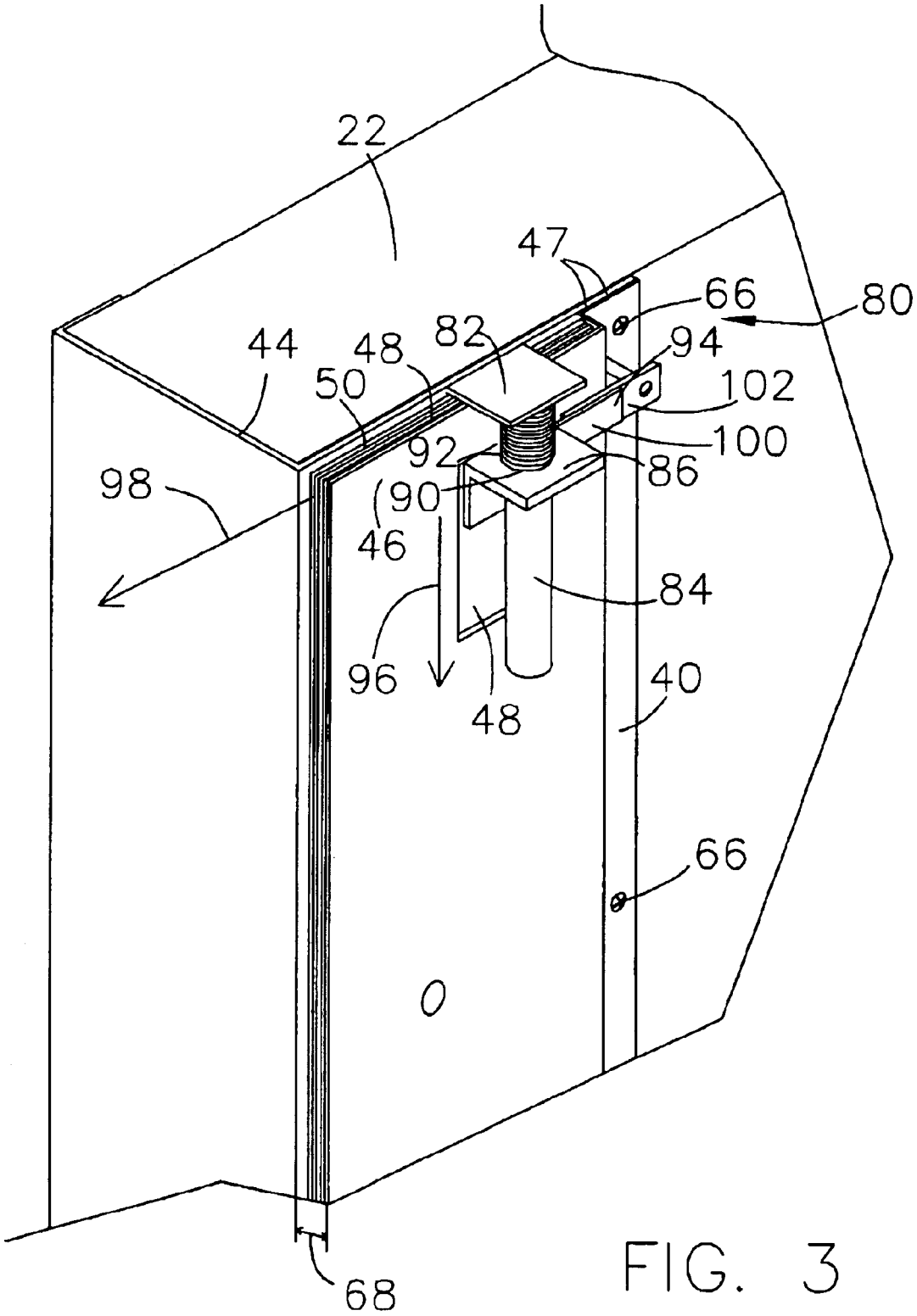
FIG. 3 shows a perspective view of a portion the fire door assembly of FIG. 1 with the extendable astragal system mounted thereon.

Referring to FIG. 3 in connection with FIG. 2, FIG. 3 shows a perspective view of a portion of first door 22 of fire door assembly 20 (FIG. 1) with extendable astragal system 40 mounted thereon. Actuating member 48 and astragal 50 are located in the housing 47. In such an orientation, astragal 50 is in a retracted position, thus enabling first door 22 and second door 24 (FIG. 1) to swing freely without regard to astragal 50. Since first and second doors 22 and 24 are enabled to swing freely without regard to an astragal, the use of a door closing coordinator mechanism for controlling the sequence in which the inactive and active doors close becomes unnecessary during normal use conditions.

A latch mechanism 80 retains astragal 50 within housing 47. Latch mechanism 80 includes a retainer bracket 82 coupled to base 44 of housing 47. A retainer pin 84 is affixed to retainer bracket 82. An actuator bracket 86 extends through a slotted opening 88 in cover 46, and is secured to actuating member 48. Retainer pin 84 movably resides in an aperture 90 in actuator bracket 86. A spring 92 is disposed on retainer pin 84 and is interposed between retainer bracket 82 and actuator bracket 86.

Latch mechanism 80 further includes a first heat-activated release element 94 in communication with actuator bracket 86 for holding actuating member 48 in an armed position, as shown in FIG. 3, when an ambient temperature of the air surrounding first door 22 is less than a pre-determined temperature. First heat-activated release element 94 functions to release actuating member 48 from the armed position when the ambient temperature is at the pre-determined temperature. When released, spring 92 imposes a downward spring force on actuator bracket 86 coupled to actuating member 48. Actuator bracket 86 moves vertically downward in slotting opening 88. Correspondingly, actuating member 48 slides in a vertically downward direction, represented by an arrow 96.

Actuating member 48 slides in vertically downward direction 96 with guide pins 70 in first guide pin slots 72 facilitating the vertical movement of actuating member 48. Movement of actuating member 48 in vertically downward direction 96 causes resultant movement of astragal 50 through slot 68 to an extended position outside of housing 47. More specifically, movement of actuating member 48 in vertically downward direction 96 causes peg members 76 to slide in peg slots 78, forcing astragal 50 to move in a direction substantially perpendicular to vertically downward direction 96. In other words, astragal 50 moves in a horizontal direction, represented by an arrow 98, with guide pins 70 in second guide pin slots 72 facilitating the horizontal movement of astragal 50. Thus, guide pins 70 function a dual purpose of guiding the movement of actuating member 48 and astragal 50, as well as maintaining a fixed distance between base 44 and cover 46 to enable unimpeded movement of actuating member 48 and astragal 50.

Figure 4:
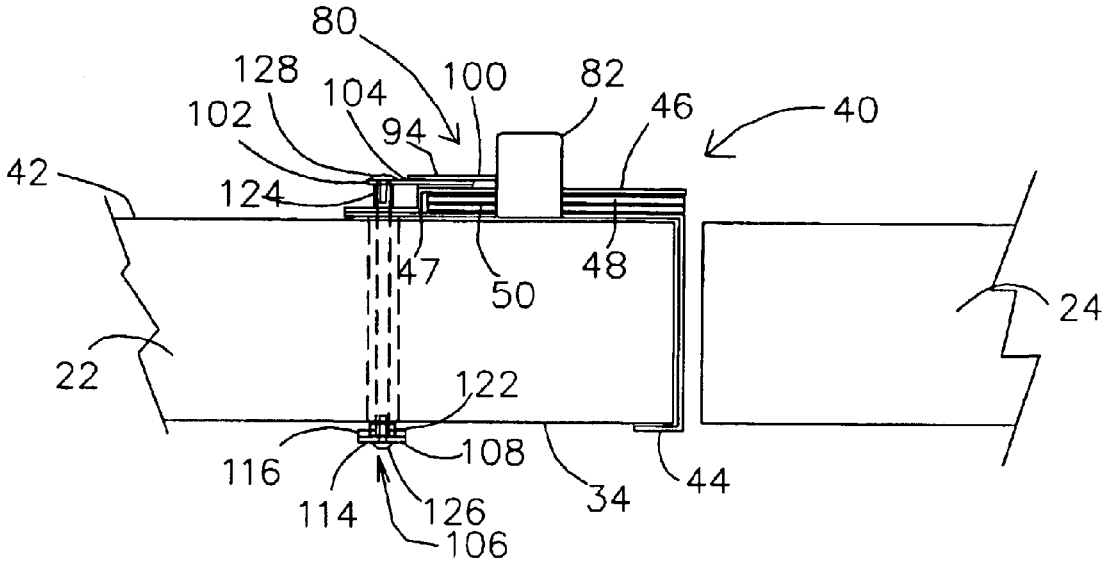
FIG. 4 shows a top view of a portion of the doors of FIG. 1 with the extendable astragal system mounted thereon.

FIG. 4 shows a top view of a portion of first and second doors 22 and 24, respectively, with extendable astragal system 40 mounted thereon. Astragal 50 is shown in the retracted position within housing 47. As mentioned briefly above, latch mechanism 80 includes first heat-activated release element 94. First heat-activated release element 94 is a first fusible link having a first section 100 abutting an underside of actuator bracket 86 (best seen in FIG. 3) and a second section 102 coupled to housing 47. The abutment of first section 100 against the underside of actuator bracket 86 retains actuating member 48 via its coupling with actuator bracket 86-in the armed position.

A thermally sensitive bonding material 104 is interposed between and secures first section 100 to second section 102. The thickness of bonding material 104 relative to first and second sections 100 and 102 is exaggerated herein for illustrative purposes only. Bonding material 104 has eutectic properties. That is, bonding material 104 is solid until it is heated to a predetermined, elevated temperature at which it liquefies. As known to those skilled in the art, a suitable eutectic bonding material may include an alloy of lead, bismuth, and indium. The proportions of these materials can be adjusted to provide a selected melting point, such as 135° F., at which bonding material 104 liquefies.

When bonding material 104 liquefies, the bond between first and second sections 100 and 102 dissolves and first and second sections 100 and 102, respectively, separate. As first and second sections 100 and 102 separate, the force of spring 92 (FIG. 3) pushing against actuator bracket 86, forces movement of actuating member 48 in downward direction 96 (FIG. 3) and resultant movement of astragal 50 in horizontal direction 98 (FIG. 3).

Figure 5:
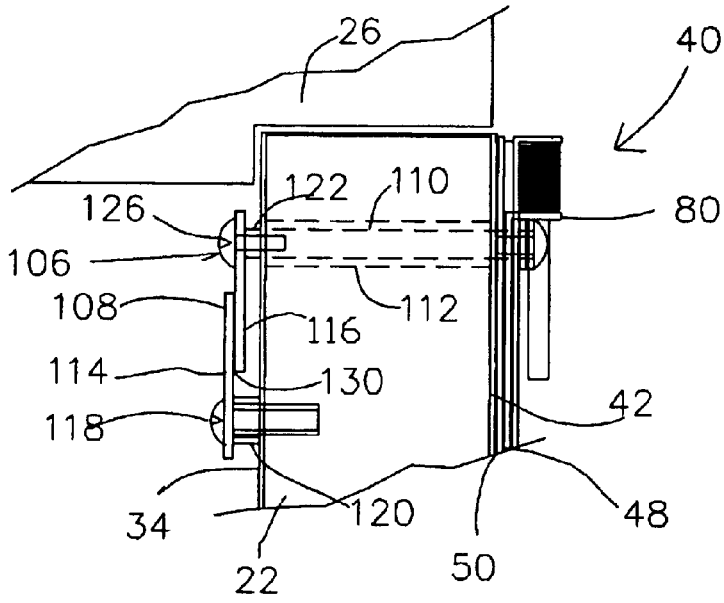
FIG. 5 shows an edge view of a portion of a first door of the fire door assembly of FIG. 1 with the extendable astragal system mounted thereon.

Referring to FIG. 5 in connection with FIG. 4, FIG. 5 shows an edge view of a portion of first door 22 of fire door assembly 20 (FIG. 1) with extendable astragal system 40 mounted thereon. When fire door assembly 20 (FIG. 1) is an interior door, i.e., a door leading from one interior space, such as a room, to another interior space, such as, a hallway, it is desirable that astragal 50 be activated when the fire is on either side of fire door assembly 20. Accordingly, astragal system 40 further includes a second heat-activated release element 106 configured for attachment to a side of first door 22 opposite from latch mechanism 80. As shown, latch mechanism 80 and first heat-activated release element 94 are positioned at exterior side 42 of first door 22. As such, second heat-activated release element 106 is located at interior side 34 of first door 22.

Second heat-activated release element 106 includes a fusible link 108 and a link member 110 configured for positioning in an aperture 112 drilled through the width of first door 22. Fusible link 108 includes a third section 114 and a fourth section 116. Third section 114 is configured for fixation to interior side 34 of first door 22. As shown, a bolt 118 couples third section 114 to interior side 34. A spacer 120 holds third section 114 an appropriate distance from interior side 34.

Link member 110 has a first end 122 secured to fourth section 116 and a second end 124 coupled to second section 102 of first heat-activated release element 94. As shown, a bolt 126 couples fourth section 116 to first end 122 of link member 110, and a bolt 128 couples second section 102 of first heat-activated release element 94 to second end 124 of link member 110. In such a manner, first heat-activated release element 94 acts as an extension member whose first extension end, i.e., second section 102 is coupled to second end 124 of link member 110, and whose second extension end, i.e., first section 100, abuts actuator bracket 86.

Like first heat-activated release element 94, a thermally sensitive bonding material 130 is interposed between and secures third section 114 to fourth section 116. Bonding material 130 has eutectic properties, and liquefies at a predetermined temperature, for example, 135° F. As above, the thickness of bonding material 130 relative to third and fourth sections 114 and 116 is exaggerated herein for illustrative purposes only.

When bonding material 130 liquefies, the bond between third and fourth sections 114 and 116, respectively, dissolves and third and fourth sections 114 and 116 separate. Link member 110 is able to pivot within aperture 112. Accordingly, as third and fourth sections 114 and 116 separate, the force of spring 92 against actuator bracket 86, pushes against first section 100 of first heat-activated release element 94. First section 100 is still attached to second section 102. Accordingly, spring force of spring 92 causes first heat-activated release element 94 coupled to link member 110 to pivot, whereby actuating member 48 moves in downward direction 96 (FIG. 3) and astragal 50 moves in horizontal direction 98 (FIG. 3).

Thus, first and second heat-activated release elements 94 and 96, respectively, enable the extension of astragal 50 whether the fire is on an interior side or an exterior side of fire door assembly 20 (FIG. 1). In an exemplary embodiment, each of first and second heat-activated release elements 94 and 96 are rated to separate when an ambient temperature is at or greater than a predetermined temperature of 135° F. When the ambient temperature reaches 135° F., bonding material 104 or bonding material 130 liquefies, and astragal 50 extends from housing 47.

Although astragal 50 extends from extendable astragal system 40 in response to heat on either side of fire door assembly 20 (FIG. 1), it should be understood that this feature is not limiting. In alternative embodiments, an extendable astragal system may include a heat-activated release element on only one side of a fire door example. For example, a heat-activated release element may not be required on the outside of fire door assembly leading from an interior space to the outdoors. In such an instance, an extendable astragal system may include second heat-activated release element 106 on the interior side of a fire door assembly, and an extension element would replace first heat-activated release element 94 on the exterior side of the fire door assembly.

Figure 6:
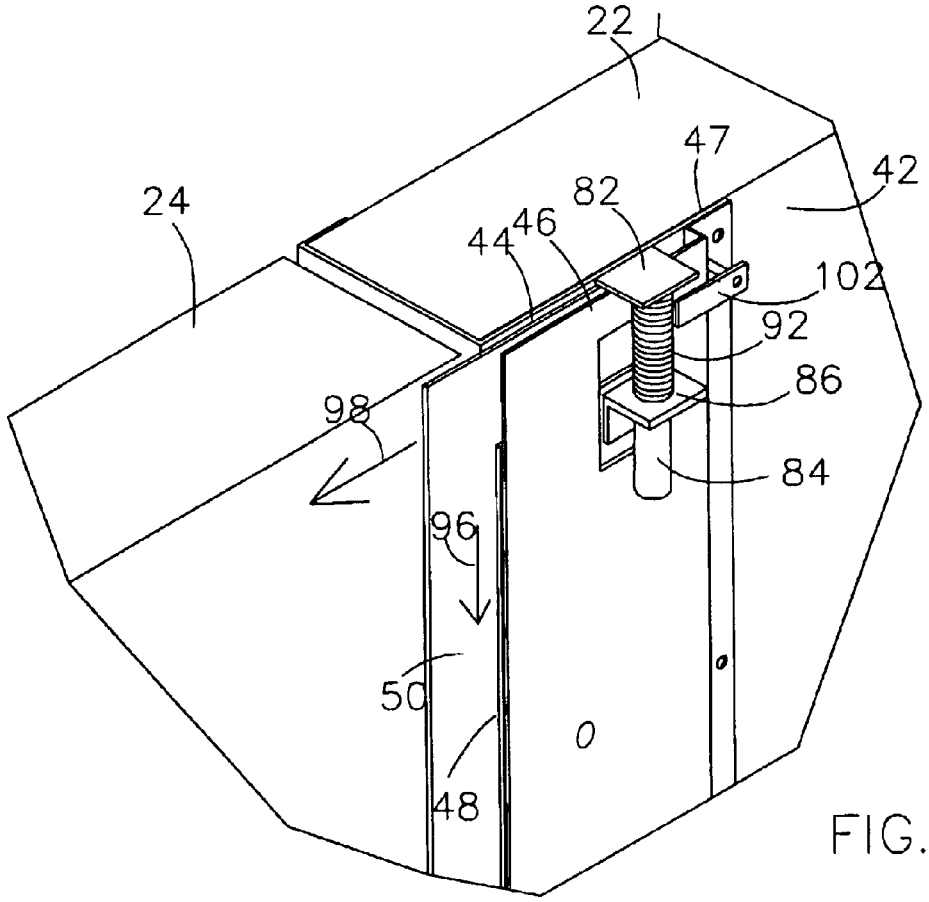
FIG. 6 shows a perspective view of a portion of first and second doors of the fire door assembly of FIG. 1 with the astragal of the extendable astragal system in an extended position.
Figure 7:
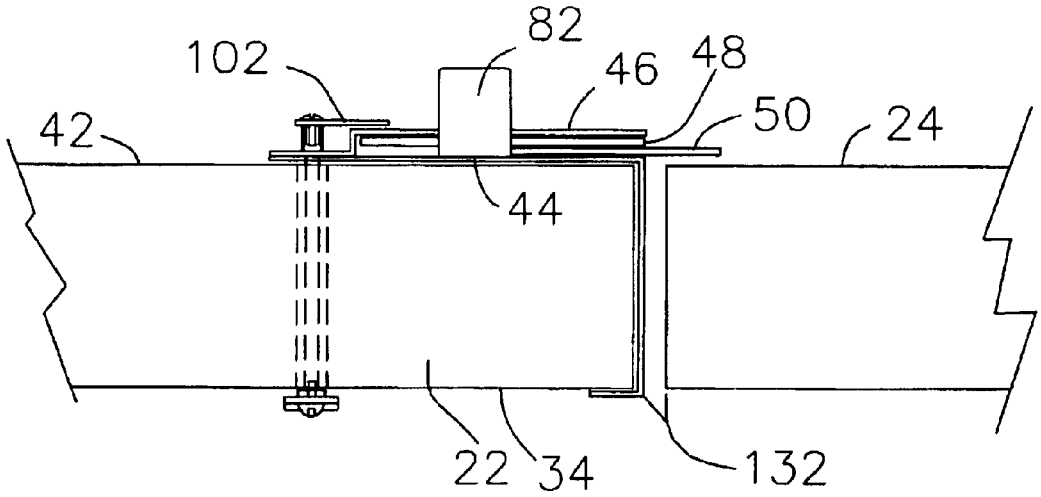
FIG. 7 shows a top view of a portion of the first and second doors with the astragal in the extended position.

Referring to FIGS. 6–7, FIG. 6 shows a perspective view of a portion of first and second doors 22 and 24, respectively, with-astragal 50 of extendable astragal system 40 in an extended position. FIG. 7 shows a top view of a portion of first and second doors 22 and 24 with astragal 50 in the extended position. FIGS. 6–7 depict a scenario in which the extension of astragal 50 results from the separation of first section 100 (FIG. 4) from second section 102. That is, when the ambient temperature on exterior side 42 of first door 22 reaches 135° F., bonding material 104 (FIG. 4) liquefies. The liquefaction of bonding material 104 causes first section 100 to fall away from second section 102, as represented by the absence of first section 100. This separation of first and second sections 100 and 102 enables spring 92 to expand and push against actuator bracket 86 secured to actuating member 48.

Actuator bracket 86 and actuating member 48 subsequently move in downward direction 96, forcing peg members 76 (FIG. 2) to travel in peg slots 78 (FIG. 2), and the resultant movement of astragal 50 in horizontal direction 98. In an exemplary embodiment, astragal 50 extends approximately three quarters of an inch from housing 47 to cover a clearance gap 132 between first and second doors 22 and 24, respectively.

Figure 8:
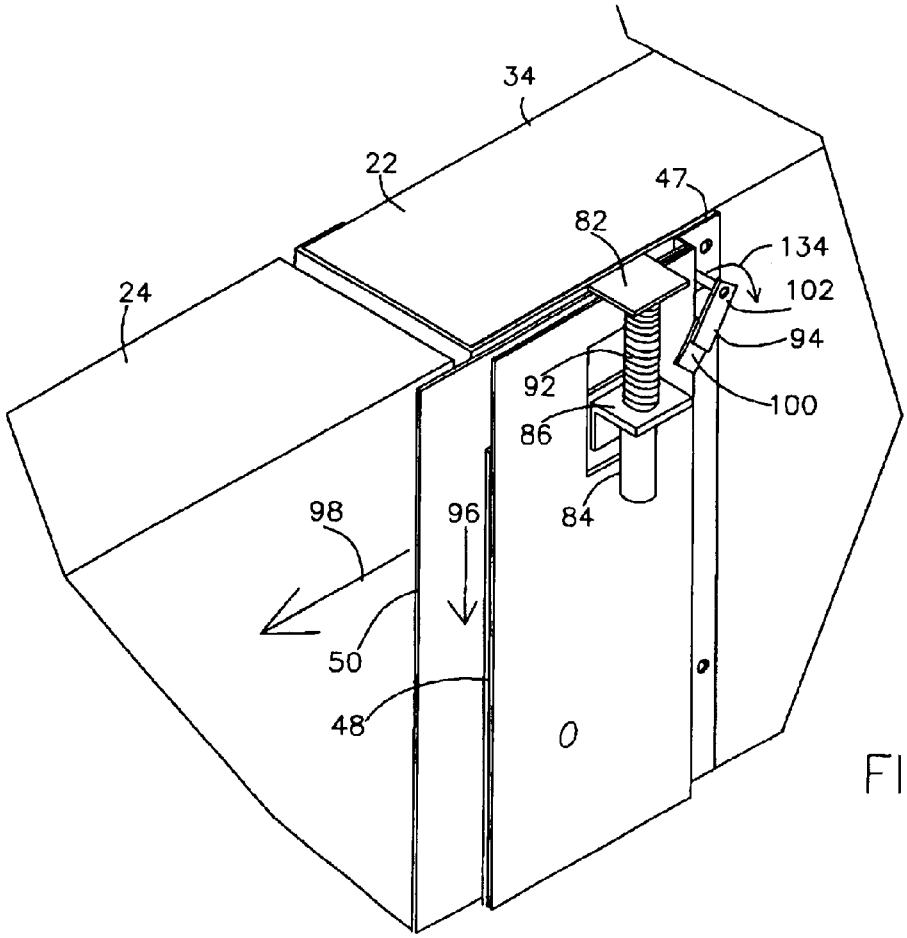
FIG. 8 shows a perspective view of a portion of first and second doors of the fire door assembly of FIG. 1 with the astragal in an extended position.
Figure 9:
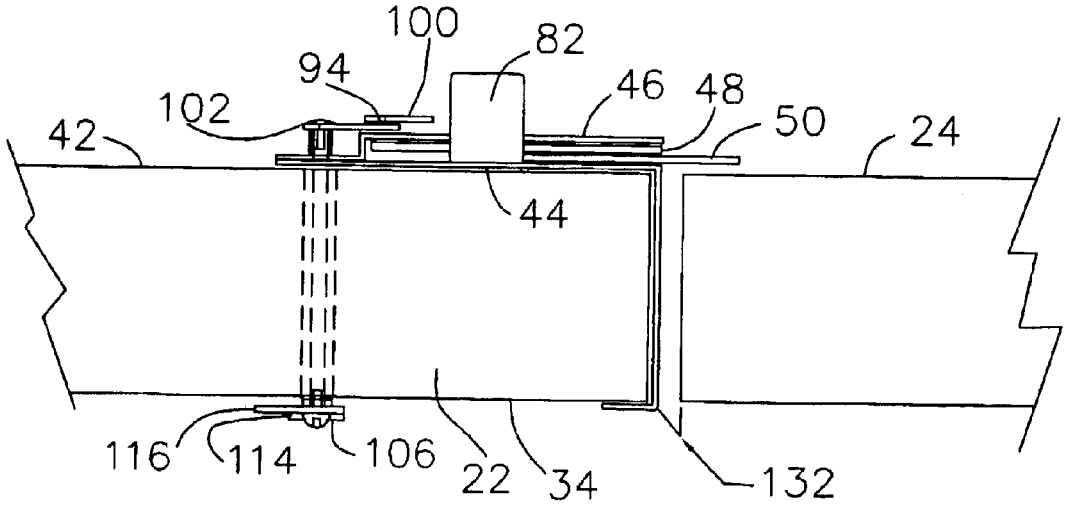
FIG. 9 shows a top view of a portion of the first and second doors with the astragal in the extended position.

Referring to FIGS. 8–9, FIG. 8 shows a perspective view of a portion of first and second doors 22 and 24, respectively, with astragal 50 of extendable astragal system 40 in an extended position. FIG. 9 shows a top view of a portion of first and second doors 22 and 24 with astragal 50 in the extended position. FIGS. 8–9 depict a scenario in which the extension of astragal 50 results from the separation of third section 114 (FIG. 5) from fourth section 116. That is, when the ambient temperature on interior side 34 of first door 22 reaches 135° F., bonding material 130 (FIG. 5) liquefies. The liquefaction of bonding material 130 causes fourth section 116 to separate from third section 114.

The force of spring 92 against actuator bracket 86 and the ability of link member 110 to pivot within aperture 112 causes first heat-activated release element 94 to pivot, as depicted by an arrow 134. The pivoting of release element 94 moves first section 100 out of abutment with actuator bracket 86. Accordingly, spring 92 expands and pushes against actuator bracket 86 secured to actuating member 48. Actuator bracket 86 and actuating member 48 subsequently move in downward direction 96, forcing the resultant movement of astragal 50 in horizontal direction 98 to extend from housing 47 and cover clearance gap 132.

In summary, the present invention teaches of an automatically extendable astragal system. The astragal system includes an astragal that is normally retracted within a housing. The astragal is only activated, or extended, to cover the clearance gap between a pair of doors when-an ambient temperature reaches a predetermined temperature. Accordingly, the astragal system enables the free movement of either door in a double door assembly under normal use conditions, without the necessity for a door closing coordinator mechanism. In addition, the astragal system includes an astragal that meets NFPA standards for an overlapping configuration with an extension of approximately three quarters of an inch.

Although the preferred embodiments of the invention have been illustrated and described in detail, it will be readily apparent to those skilled in the art that various modifications may be made therein without departing from the spirit of the invention or from the scope of the appended claims. For example, a single heat-activated release element may be placed only on an interior or exterior side of the door instead of both sides of the door as described herein.

What is claimed is:

1. An extendable astragal system for a door comprising:

a housing;

an actuating member located in said housing and slidably engaged with said housing;

an astragal located in said housing and slidably engaged with each of said housing and said actuating member; and a latch mechanism retaining said astragal within said housing in a retracted position when an ambient temperature is below a predetermined temperature, and said latch mechanism enabling sliding movement of said actuating member and resultant movement of said astragal to an extended position outside of said housing when said ambient temperature is at said predetermined temperature.

2. An extendable astragal system as claimed in claim 1 wherein said housing comprises:

a base having a first longitudinal edge and a second longitudinal edge; and a cover having a third longitudinal edge and a fourth longitudinal edge, said third longitudinal edge being aligned with and coupled to said first longitudinal edge to form a closed side of said housing, said fourth longitudinal edge being aligned with said second longitudinal edge, and said second and fourth longitudinal edges defining a slot through which said astragal extends from said housing.

3. An extendable astragal system as claimed in claim 2 further comprising spacers extending between said base and said cover.

4. An extendable astragal system as claimed in claim 1 wherein:

said system further comprises guide pins secured to and extending through a width of said housing;

said actuating member includes first guide pin slots; and said astragal includes second guide pin slots oriented substantially perpendicular to said first guide pin slots, said guide pins extending through each of said first and second guide pin slots.

5. An extendable astragal system as claimed in claim 4 wherein said first guide pin slots are oriented substantially vertically, a first direction of movement of said actuating member is a vertical downward movement, and a second direction of movement of said astragal is a horizontal movement.

6. An extendable astragal system as claimed in claim 1 wherein:

said astragal includes peg members extending from a surface of said astragal; and said actuating member includes peg slots in which said peg members slidably reside, said peg slots being oriented at an acute angle relative to horizontal, and movement of said actuating member forces movement of said peg members in said peg slots.

7. An extendable astragal system as claimed in claim 1 wherein said latch mechanism comprises:

a retainer bracket coupled to said housing;

a retainer pin affixed to said retainer bracket;

an actuator bracket extending through said housing and secured to said actuating member, said retainer pin moveably residing in an aperture in said actuator bracket; and a heat-activated release element in communication with said actuator bracket for holding said actuating member in an armed position and releasing said actuating member from said armed position when said ambient temperature is at said predetermined temperature.

8. An extendable astragal system as claimed in claim 7 wherein said housing includes a slotted opening in which said actuator bracket is positioned for securing to said actuating member.

9. An extendable astragal system as claimed in claim 7 wherein said latch mechanism further comprises a spring disposed on said retainer pin and interposed between said retainer and said actuator brackets.

10. An extendable astragal system as claimed in claim 7 wherein said heat-activated release element comprises a fusible link having a first section abutting said actuator bracket, a second section coupled to said housing, and a thermally sensitive bonding material securing said first section to said second section, said first section being separable from said second section in response to liquefaction of said bonding material when said ambient temperature is at said predetermined temperature.

11. An extendable astragal system as claimed in claim 7 wherein said heat-activated release element is configured for attachment to a side of said door opposite from said latch mechanism.

12. An extendable astragal system as claimed in claim 11 wherein said heat-activated release element comprises:

a fusible link including:

a first section configured for fixation to said opposite side of said door;

a second section; and a thermally sensitive bonding material securing said first section to said second section, said first section being separable from said second section in response to liquefaction of said bonding material when said ambient temperature is at said predetermined temperature; and a link member having a first end secured to said second section of said fusible link and a second end in releasable communication with said actuator bracket.

13. An extendable astragal system as claimed in claim 12 wherein said heat-activated release element further comprises an extension member having a first extension end coupled to said second end of said link member, and a second extension end abutting said actuator bracket, said extension member pivoting in response to release of said first section from said second section.

14. An extendable astragal system as claimed in claim 7 wherein said heat-activated release element is a first heat-activated release element configured for positioning on a first side of said door, and said latch mechanism further comprises a second heat-activated release element configured for positioning on a second side of said door, said second heat-activated release element being in releasable communication with said actuator bracket.

15. An extendable astragal system for a door comprising:

a housing;

guide pins secured to and extending through a width of said housing;

an actuating member located in said housing and slidably engaged with said housing, said actuating member having first guide pin slots, and said actuating member having peg slots oriented at an acute angle relative to horizontal;

an astragal located in said housing and slidably engaged with each of said housing and said astragal, said astragal including second guide pins slots oriented substantially perpendicular to said first guide pin slots, said guide pins extending through each of said first and second guide pin slots, and said astragal further including peg members extending from a surface of said astragal and slidably residing in said peg slots; and a latch mechanism retaining said astragal within said housing when an ambient temperature is below a predetermined temperature, said latch mechanism enabling sliding movement of said actuating member in a first direction substantially parallel to a longitudinal dimension of said first guide pin slots, and resultant movement of said astragal in a second direction substantially parallel to a longitudinal dimension of said second guide pin slots to an extended position outside of said housing when said ambient temperature is at said predetermined temperature.

16. An extendable astragal system as claimed in claim 15 wherein said housing comprises:

a base having a first longitudinal edge and a second longitudinal edge; and a cover having a third longitudinal edge and a fourth longitudinal edge, said third longitudinal edge being aligned with and coupled to said first longitudinal edge to form a closed side of said housing, said fourth longitudinal edge being aligned with said second longitudinal edge, and said second and fourth longitudinal edges defining a slot through which said astragal extends from said housing.

17. An astragal system as claimed in claim 15 wherein said latch mechanism comprises:

a retainer bracket coupled to said housing;

a retainer pin affixed to said retainer bracket;

an actuator bracket extending through said housing and secured to said actuating member, said retainer pin moveably residing in an aperture in said actuator bracket; and a heat-activated release element in communication with said actuator bracket for holding said actuating member in an armed position and releasing said actuating member from said armed position when said ambient temperature is at said pre-determined temperature.

18. An extendable astragal system for a door comprising:

a housing including a base and a cover, said base having a first longitudinal edge and a second longitudinal edge, said cover having a third longitudinal edge and a fourth longitudinal edge, said third longitudinal edge being aligned with and coupled to said first longitudinal edge to form a closed side of said housing, said fourth longitudinal edge being aligned with said second longitudinal edge, and said second and fourth longitudinal edges defining a slot;

an actuating member located in said housing and slidably engaged with said housing;

an astragal located in said housing and slidably engaged with each of said housing and said actuating member; and a latch mechanism for enabling movement of said astragal from a retracted position within said housing through said slot to an extended position outside of said housing, said latch mechanism including:

a retainer bracket coupled to said housing;

a retainer pin affixed to said retainer bracket;

an actuator bracket extending through said housing and secured to said actuating member, said retainer pin moveably residing in an aperture in said actuator bracket; and a heat-activated release element in communication with said actuator bracket for holding said actuating member in said retracted position when an ambient temperature is below a predetermined temperature, and said heat-activated release element enabling sliding movement of said actuating member and resultant movement of said astragal to said extended position when said ambient temperature is at said predetermined temperature.

19. An extendable astragal system as claimed in claim 18 wherein said heat-activated release element is a first heat-activated release element configured for positioning on a first side of said door, and said latch mechanism further comprises a second heat-activated release element configured for positioning on a second side of said door, said second heat-activated release element being in releasable communication with said actuator bracket.

20. An extendable astragal system as claimed in claim 19 wherein:

said first heat-activated release element comprises a first fusible link having a first section abutting said actuator bracket, a second section coupled to said housing, and a thermally sensitive bonding material securing said first section to said second section; and said second heat-activated release element comprises a second fusible link including:

a third section configured for fixation to said second side of said door;

a fourth section; and a thermally sensitive bonding material securing said third section to said fourth section; and a link member having a first end secured to said fourth section of said second fusible link and a second end secured to said second section of said first fusible link, said first section being separable from said second section in response to liquefaction of said bonding material when said ambient temperature at said first side of said door is at said predetermined temperature, said third section being separable from said fourth section in response to liquefaction of said bonding material when said ambient temperature at said second side of said door is at said predetermined temperature, said first fusible link pivoting in response to release of said third section from said fourth section.

* * * * *